US010101137B2

(12) United States Patent
Burczynski

(10) Patent No.: US 10,101,137 B2
(45) Date of Patent: Oct. 16, 2018

(54) HEAT-MITIGATING NOSE INSERT FOR A PROJECTILE AND A PROJECTILE CONTAINING THE SAME

(71) Applicant: Sig Sauer, Inc., Newington, NH (US)

(72) Inventor: Thomas J. Burczynski, Montour Falls, NY (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/870,400

(22) Filed: Jan. 12, 2018

(65) Prior Publication Data

US 2018/0195844 A1 Jul. 12, 2018

Related U.S. Application Data

(60) Provisional application No. 62/445,473, filed on Jan. 12, 2017.

(51) Int. Cl.
*F42B 10/00* (2006.01)
*F42B 10/46* (2006.01)
(Continued)

(52) U.S. Cl.
CPC ..... *F42B 10/46* (2013.01); *F42B 12/34* (2013.01); *F42B 12/72* (2013.01)

(58) Field of Classification Search
CPC ..... F42B 10/38; F42B 10/42; F42B 10/46; F42B 12/34; F42B 12/72; F42B 12/74; F42B 12/745; F42B 12/78
See application file for complete search history.

(56) References Cited

U.S. PATENT DOCUMENTS 1,107,722 A * 8/1914 Starkweather ..... F42B 12/34 102/507
3,971,024 A * 7/1976 Clark, Jr. ..... H01Q 1/281 102/211
(Continued)

FOREIGN PATENT DOCUMENTS

DE 9219134 U1 * 4/1998 ..... F42B 12/74
DE 19930473 A1 * 1/2001 ..... F42B 12/34
DE 19930474 A1 * 1/2001 ..... F42B 12/34

OTHER PUBLICATIONS

Emary, Dave, "A Technical Discussion of the ELD-X™ (Extremely Low Drag—eXpanding) & ELD™ Match (Extremely Low Drag Match) Bullets with Heat Shield™ Tip," dated Oct. 2015, 23 pages.

*Primary Examiner* — Gabriel J. Klein
(74) *Attorney, Agent, or Firm* — Finch & Maloney PLLC

(57) ABSTRACT

Techniques and devices are disclosed for a nose insert and a projectile that include a polymer nose element and a metal tip. The polymer nose element includes a tapered head portion and a first shank portion attached to the tapered head portion. The tapered head portion includes a cavity disposed therein. The first shank portion includes a first diameter smaller than a width of the tapered head portion adjacent to the first shank portion. The metal tip disposed in the tapered head portion of the polymer nose element and includes a tapered end and a second shank portion attached to the tapered end. The second shank portion having a second diameter smaller than a width of the tapered end adjacent to the second shank portion. The second shank portion being received in the cavity within the tapered head portion of the polymer nose element.

19 Claims, 9 Drawing Sheets

(51) Int. Cl.
*F42B 12/34* (2006.01)
*F42B 12/72* (2006.01)

(56) References Cited

U.S. PATENT DOCUMENTS

| | | | | | |
|---|---|---|---|---|---|
| 4,776,279 | A * | 10/1988 | Pejsa | F42B 12/34 | 102/510 |
| 5,621,186 | A * | 4/1997 | Carter | F42B 12/34 | 102/507 |
| 7,299,750 | B2 * | 11/2007 | Schikora | F42B 12/34 | 102/506 |
| 2006/0124022 | A1 * | 6/2006 | Eberhart | F42B 12/34 | 102/508 |
| 2012/0111220 | A1 * | 5/2012 | King | F42B 12/34 | 102/509 |
| 2016/0169645 | A1 | 6/2016 | Emary et al. | | |
| 2018/0094911 | A1 * | 4/2018 | Fournier | F42B 12/34 | |

* cited by examiner

HEAT-MITIGATING NOSE INSERT FOR A PROJECTILE AND A PROJECTILE CONTAINING THE SAME

CROSS-REFERENCE TO RELATED APPLICATIONS

This application claims the benefit of U.S. Provisional Patent Application No. 62/445,473, filed on Jan. 12, 2017, which is herein incorporated by reference in its entirety.

FIELD OF THE DISCLOSURE

This disclosure relates to firearm ammunition, and more particularly to a heat-resistant nose insert for a projectile.

BACKGROUND

Firearms, such as rifles, are used in target or match shooting competitions and for hunting sporting game. A firearm is configured to launch a bullet towards a target located within an area. The bullet is designed to travel through the air and impact the target located at a distance away from a shooter's position within the area. Before firing, the bullet is disposed within a cartridge that includes a propellant and a primer. Upon activating a trigger assembly of the firearm, a firing pin within the firearm engages the primer to discharge the propellant to launch the bullet through the barrel of the firearm and towards the intended target.

SUMMARY OF THE DISCLOSURE

One example embodiment of the present disclosure provides a nose insert for use in a projectile including a polymer nose element including a tapered head portion and a first shank portion attached to the tapered head portion, the tapered head portion includes a cavity disposed therein, and the first shank portion includes a first diameter smaller than a width of the tapered head portion adjacent to the first diameter; and a metal tip disposed in the tapered head portion of the polymer nose element, the metal tip includes a tapered end and a second shank portion attached to the tapered end, and the second shank portion having a second diameter smaller than a width of the tapered end adjacent to the second diameter, wherein the second shank portion received in the cavity within the tapered head portion of the polymer nose element. In some cases, a largest width of the tapered head portion of the polymer nose element forms a shoulder in a plane perpendicular to an axis of the polymer nose element. In other cases, the tapered head portion of the polymer nose element is ogival in shape and terminates in a flat face at a forward end of the polymer nose element. In yet other cases, the tapered end of the metal tip is ogival in shape and terminates in a meplat at a forward end of the metal tip. In some cases, an ogive radius for an outer surface profile of the tapered head portion of the polymer nose element and an outer surface profile of a tapered point of the metal tip are the same. In other cases, the second diameter of the second shank portion of the metal tip is larger than an inside diameter of the cavity of the polymer nose element. In yet some other cases, the metal tip is made from one of aluminum, aluminum alloy copper, a copper alloy, bronze, brass, mild steel, stainless steel or any metal having a melt temperature of at least 1200 degrees F. In some cases, the metal tip can withstand stagnation temperatures of between 1,200 and 2,700 degrees F. during flight of the projectile without deformation of the nose insert. In yet other cases, a largest width of the tapered end of the metal tip forms a shoulder in a plane perpendicular to an axis of the metal tip. In some cases, the shoulder of the metal tip includes an underside in contact with a flat face of the polymer nose element. In other cases, the second shank portion of the metal tip is in contact with a bottom surface of the cavity of the polymer nose element.

Another example embodiment of the present disclosure provides a projectile including a unitary body including a first end and a second end, the first end including a first cavity; and a nose insert disposed in the unitary body, the nose insert including a polymer nose element disposed within the unitary body, the polymer nose element including a tapered head portion and a first shank portion attached to the tapered head portion, the tapered head portion includes a second cavity disposed therein, and the first shank portion includes a first diameter smaller than a width of the tapered head portion adjacent to the first diameter, wherein the first shank portion is received in the first cavity of the unitary body, and a metal tip disposed in the tapered head portion of the polymer nose element, the metal tip includes a tapered end and a second shank portion attached to the tapered end, the second shank portion having a second diameter smaller than a width of the metal tip adjacent to the second diameter, wherein the second shank portion is received in the second cavity within the tapered head portion of the polymer nose element. In some cases, the projectile further includes an ogive radius for each of an outer surface profile of the tapered head portion of the polymer nose element and an outer surface profile of a jacketed portion of the projectile, wherein the ogive radius is the same for each of the outer surface profile of the tapered head portion of the polymer nose element and the outer surface profile of a jacketed portion of the projectile. In other cases, the projectile further includes an ogive radius for each of an outer surface profile of the tapered head portion of the polymer nose element and an outer surface profile of the tapered end of the metal tip, wherein the ogive radius is the same for each of the outer surface profile of the tapered head portion of the polymer nose element and the outer surface profile of the tapered end of the metal tip. In yet some other cases, the projectile further includes an ogive radius for each of an outer surface profile of the tapered head portion of the polymer nose element, an outer surface profile of the tapered end of the metal tip, and an outer surface profile of a jacketed portion of the projectile, wherein the ogive radius is the same for each of the outer surface profile of the tapered head portion of the polymer nose element, the outer surface profile of the tapered end of the metal tip, and the outer surface profile of a jacketed portion of the projectile. In some cases, the unitary body further comprises a core that defines the first cavity, the first cavity being a cylindrical cavity concentric with an axis of the projectile. In other cases, the unitary body further comprises a forward portion that defines an opening to the first cavity, the forward portion in contact with the first shank portion of the polymer nose element so as to secure the nose insert to the unitary body. In yet other cases, the nose insert is disposed within the unitary body, such that a rear surface of the first shank portion of the polymer nose element is not in contact with a bottom surface of the first cavity of the unitary body. In some such cases, in response to impact of the projectile with a target, the nose insert is configured to move rearward within the first cavity of the unitary body to expand the projectile.

Another example embodiment of the present disclosure provides a nose insert for use in a projectile including a polymer nose element including a tapered head at a first end and a first shank portion attached to the tapered head, the tapered head includes a cavity disposed therein and a first diameter, and the first shank portion includes a second diameter smaller than the first diameter of the tapered head adjacent to the first shank portion; and a metal tip disposed in the first end of the polymer nose element, wherein the metal tip includes a tapered end including a third diameter and a second shank portion, the second shank portion having a fourth diameter smaller than the third diameter of the tapered end adjacent to the second shank portion, the second shank portion is received in the cavity within the tapered head of the polymer nose element. In some instances, the metal tip is made from one of aluminum, aluminum alloy copper, a copper alloy, bronze, brass, mild steel, stainless steel or any metal having a melt temperature of at least 1200 degrees F. In other instances, the polymer nose element is manufactured from at least one of a crystalline or an amorphous polymer. In yet other instances, the largest width of the tapered head portion of the polymer nose element forms a shoulder, the shoulder includes an underside in which the underside is in a plane perpendicular to an axis of the polymer nose element. In some instances, the largest width of the tapered end of the metal tip forms a shoulder, the shoulder includes an underside in which the underside is in a plane perpendicular to an axis of the metal tip. In some such instances, the underside of the shoulder of the metal tip is in contact with a flat face of the polymer nose element. In other such instances, the shoulder of the metal tip prevents the polymer nose element from melting or deforming during flight of the projectile. In some other instances, the tapered head portion of the polymer nose element is ogival in shape and terminates in a flat face at a forward end of the polymer nose element. In other instances, the tapered end of the metal tip is ogival in shape and terminates in a meplat at a forward end of the metal tip. In some such instances, the meplat of the metal tip is flat and has a diameter between 0.001 and 0.100 of an inch. In some other such instances, the meplat of the metal tip is defined by a radius having a width between 0.001 and 0.100 of an inch. In some instances, the shank portion of the polymer nose element is a dual-diameter cylindrical shank. In other instances, the shank portion of the polymer nose element is a single-diameter cylindrical shank. In yet other instances, the fourth diameter of the shank portion of the metal tip is larger than an inside diameter of the cavity of the polymer nose element. In some instances, the metal tip can withstand stagnation temperatures of between 1,200 and 2,700 degrees F. without deformation. In other instances, the metal tip prevents the polymer nose element from melting or deforming in flight and the polymer nose element causes the projectile to expansion on impact with a target. In yet some other instances, an ogive radius for an outer surface profile of the tapered head of the polymer nose element and an outer surface profile of the tapered point of the metal tip are the same. In some such instances, the ogive radius is a tangent ogive. In other such instances, the ogive radius is a secant ogive. In some instances, the polymer nose element includes a forward terminus, the forward terminus having a width equal to a width of a rear portion of the rear shank of the metal tip. In other instances, the metal tip may be one of anodized, dyed or colored.

Another example embodiment of the present disclosure provides a projectile including a unitary body including a first end and a second end, the first end including a first cavity; a polymer nose element disposed within the cavity of the unitary body, the polymer nose element including a tapered head at a first end and a first shank portion attached to the tapered head and received in the first cavity of the unitary body, the tapered head includes a second cavity disposed therein and a first diameter, and the first shank portion includes a second diameter smaller than the first diameter of the tapered head adjacent to the first shank portion; and a metal tip disposed in the first end of the polymer nose element, wherein the metal tip includes a tapered end including a third diameter and a second shank portion having a fourth diameter smaller than the third diameter of the tapered end adjacent to the second shank portion, the second shank portion is received in the second cavity within the tapered head of the polymer nose element. In some cases, the projectile further includes an ogive radius for each of a first outer surface profile of the tapered head of the polymer nose element, a second outer surface profile of the tapered point of the metal tip, and a third outer surface profile of a jacketed portion of the projectile, wherein the are the ogive radius is the same for each of the first outer surface profile of the tapered head of the polymer nose element, the second outer surface profile of the tapered point of the metal tip, and the third outer surface profile of a jacketed portion of the projectile. In other cases, the ogive radius is a tangent ogive. In yet other cases, the ogive radius is a secant ogive. In some cases, a rear end of the projectile includes a boat tail shape. In yet other cases, a rear end of the projectile includes a flat base shape.

Additional features of the present disclosure exist and will be described hereinafter and which will form the subject matter of the attached claims.

These and various other advantages, features, and aspects of the embodiments will become apparent and more readily appreciated from the following detailed description of the embodiments taken in conjunction with the accompanying drawings, as follows.

DETAILED DESCRIPTION

Figure 1:
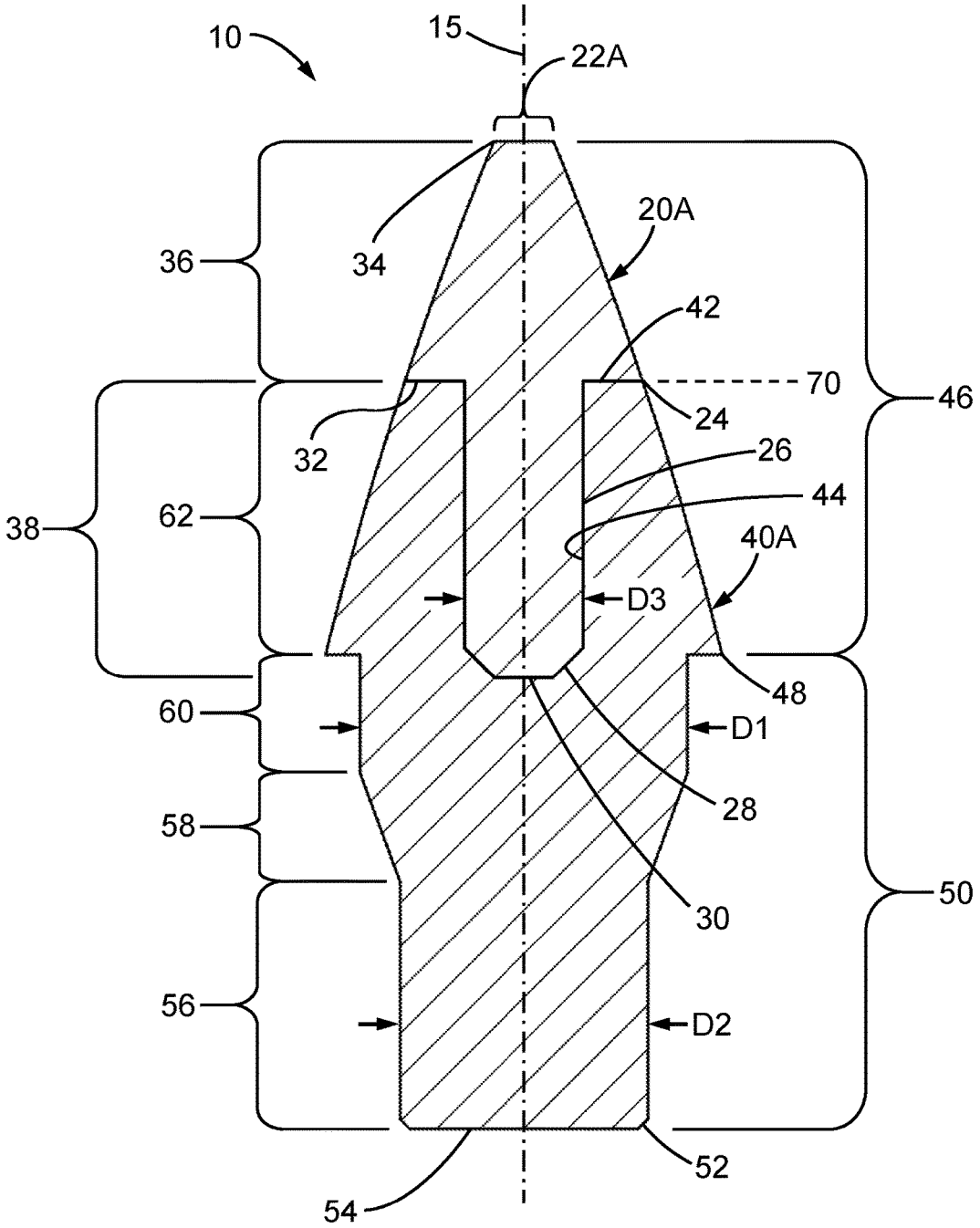
FIG. 1 is a longitudinal cross-sectional view of a nose insert for a projectile including a polymer nose element and a metal tip, in accordance with an embodiment of the present disclosure.

The disclosure is generally directed to a two-component hybrid nose insert for use in a projectile that prevents tip deformation (e.g., melting) during projectile flight. The nose insert includes a resilient polymer nose element containing a rigid metal tip that does not deform in flight. The rigid metal tip also prevents the polymer nose element from melting or deforming in flight. In the case of a hunting projectile, the rigid metal tip and resilient polymer element coalesce or are otherwise combined together to provide both high retained velocity during projectile flight and the ability to expand or mushroom on impact with a target at long range.

General Overview

The requirements for a long-range projectile vary and depend upon the particular activity in which the shooter engages, such as hunting or competitive target shooting. Long-range target shooting or match shooting, for example, requires a very accurate, extremely well-balanced projectile having a high Ballistic Coefficient (BC). The BC is an index of projectile deceleration in free flight expressed mathematically in equation (1), shown below.

$$C = \frac{W}{id^2} \qquad \text{Equation (1)}$$

Where:

C—Ballistic Coefficient

W—Mass, in pounds i—Coefficient of Form (i.e., form factor)

d—Bullet Diameter, in inches

The BC represents the ability of a bullet to overcome the air resistance in flight. Generally speaking, most long-range projectiles used for target shooting provide poor terminal performance if used for hunting game animals. Terminal performance is a measure of a projectile's behavior upon impact with a given target, for example an amount the projectile expands (e.g., mushrooms) or the depth a projectile penetrates the target at extended range. On the other hand, hunting projectiles can be less accurate than target projectiles but possess a reasonably high BC while providing exceptional terminal performance. Over many years, attempts have been made to design projectiles that meet both requirements of long-range accuracy and terminal performance. These efforts have been met with varying degrees of success.

Boat tail hollow point (BTHP) projectiles, for example, provide accuracy, good aerodynamics and a reduction in time of flight from the firearm muzzle to a target. Reduced flight time is important with respect to long-range targets because atmospheric conditions have less time to adversely affect the flight of the projectile, and thus degrade its accuracy. BTHP projectiles can be used for both match shooting and hunting, but the downside in either case is a lower than ideal BC results due to the relatively large size of the projectile's "meplat" (defined here for convenience as "the blunt tip of a projectile, specifically the tip's diameter"). Several factors determine a projectile's BC but the width and resultant square area of a projectile's meplat is a key factor that can significantly raise or lower its BC depending on its size. While a boat tailed Open Tip Match (OTM) projectile has a velocity conserving advantage over a BTHP hunting projectile in that its meplat is smaller (due to a very small cavity centered within the meplat), its relatively large width still limits its BC. In order for a hunting projectile having a hollow point cavity to reliably expand upon impact with a target at long range, the diameter of the hollow point cavity within its meplat must be of sufficiently large. Thus, the hunting projectile has a wider meplat than that of an OTM projectile.

Alternatives to BTHP projectiles have existed for decades. For example, large, pointed metal tips machined from metals, such as bronze, brass or aluminum, are used as nose inserts. Various problems existed with such designs. At long ranges (e.g., greater than 200 yards), for example, these projectiles often do not expand sufficiently, if at all, upon impact with the target, and thus provide poor terminal performance. In addition, after assembly of the projectile any appreciable eccentricity or skew that exists at the inserted tip along an axis of the projectile can degrade the accuracy of the projectile. Finally, the cost of machining large metal tips from bronze, for example, is inordinately high.

Alternatively, pointed polymer tipped projectiles, such as flat base hollow point projectiles, exposed lead-tip projectiles, metal-tipped projectiles and OTM projectiles, have been used to achieve the above-stated requirements. But these designs have also failed to achieve those requirements. In general, a common polymer tip has a "head" portion (the relatively sharp, exposed portion in a finished, jacketed or all-copper projectile) and a "shank" portion which is locked in place and hidden from view inside a portion of the projectile's ogive area. An ogive area is a pointed, curved surface used to form an approximately streamlined nose of a projectile. The most common polymers used to make polymer tips are: polycarbonate (classified as an "amorphous" polymer), nylon, and an acetal homopolymer resin sold as DELRIN® by DuPont™ (the latter two, classified as "crystalline" polymers). All of these materials, while relatively tough, are also malleable and deformable during a high impact collision such as a projectile striking a fluid-based target.

A polymer tip is generally formed by injection molding and is thereafter inserted and secured within the nose area of the projectile using a swaging or crimping process whereby the fore portion of its shank, just rearward of its tapered head portion, is gripped and held in place by the rim of an open end of a jacket. The shank portion of a polymer tip may comprise a single (cylindrical) diameter or a dual diameter, where the fore portion of its shank is larger than its aft portion. In either case, a portion of the shank is typically centered and held within a cavity formed in a core material of the jacket of the projectile. The core material may provide additional grip to a portion of the shank. In some instances, an air space may exist between the core material and a tail end of the shank of the polymer tip. The air space allows the entire polymer tip to be driven rearward on impact of the projectile with a target, to initiate radial expansion of the projectile within the target. Depending on projectile design and the shank geometry of the tip, an additional air space may exist about a forward portion of the shank.

Polymer tips offer several advantages, including: (1) can be mass-produced quickly and uniformly via injection molding, (2) can be molded to precisely match the curvature of the projectile's ogive, (3) the radius or flat comprising a meplat of a tip can be relatively small, (4) as a result of its low density, even if the polymer tip is slightly askew relative to the projectile axis, it produces almost no adverse aerodynamic effect, (5) unlike soft, lead-tipped projectiles, polymer tips are tougher, and if the tip radius or flat at the extreme tip is large enough, it can resist tip-flattening under recoil when contained in the magazine box of a firearm, (6) polymer materials are relatively inexpensive, and (7) polymer materials provide long-range expansion due to a hydraulic effect within the projectile ogive on impact.

Polymer-tipped projectiles are popular for two reasons: (1) the perception that the sharp tips afforded a higher BC (and therefore maximum velocity retention) over the course of the projectile's flight, and (2) polymers possess the ability to deform on impact and thereby initiate radial projectile expansion, even at long ranges. However, a recent discovery by the HORNADY® Manufacturing Company (hereafter, HORNADY®) revealed a reduction of the BC of polymer-tipped projectiles occurs over the course of projectile flight. The results of these tests were disclosed by HORNADY® in United States Patent Application Publication No. 20160169645, Emary, David E.; et al., (hereafter, "Hornady patent application") as well as in a technical article published by HORNADY® having the title "ELD-X_ELD-Match_Technical_Details.pdf".

HORNADY® tested its own projectiles, as well as, the crystalline polymer-tipped projectiles marketed by its competitors as long-range projectiles. The tests were conducted over a long range using Doppler radar. Projectile velocity was recorded at many points along the path of the projectile and it was discovered that the BC decreased steadily as the projectile travelled downrange until the velocity dropped below approximately 2,200 feet per second (fps). The decrease in BC indicates an increase in drag over a segment of the projectile's flight. From those results, it was determined that deformation of the crystalline polymer tip (e.g., softening or melting), created drag that reduced the BC of the projectile. Deformation, such as the softening (or melting), of the pointed tip in the high-temperature supersonic airflow caused the tip to flatten, and thereby increase the frontal area of the tip as the projectile traveled downrange. As a result, the projectile experiences an increase in drag during flight.

Follow-up Doppler radar tests were conducted by HORNADY® using BTHP projectiles with precisely machined metal noses of increasing meplat diameter. All of the projectiles tested were of identical shape other than their nose diameter and all were fired at the same velocity. The downrange results of those tests revealed that the BC of the projectile dropped 6% with a .08 caliber increase in nose diameter. For a .30 caliber projectile, this is a 0.02464-inch increase in the nose diameter.

From these tests, HORNADY® concluded that current designs of crystalline polymer tips suffer from tip melting and flattening above a velocity of 2,400 fps due to aerodynamic heating. At high speeds through the air, a projectile's kinetic energy is converted to heat through compression and friction. Aerodynamic "stagnation temperature" is the temperature that develops at a point (e.g., the meplat area of a projectile tip) directly behind a shock wave in which the air flow is completely stagnant (stopped). The aerodynamic stagnation temperature on the point (meplat) of a projectile at 2,400 fps is approximately 570 degrees Fahrenheit (F). Depending on projectile weight, modern hunting and target rifle cartridges typically produce velocities within 2,800 to 3,200 fps but some, like the 6.5-300 Weatherby Magnum cartridge, for example, can easily propel a 130 grain, high-BC projectile beyond 3,500 fps. The stagnation temperature at 3,500 fps can exceed 1,048 degrees F. Both commercial and "wildcat" varmint cartridges can produce velocities as high as 4,500 fps, which can add greatly to the stagnation temperature, especially if the projectile has a BC above 0.400 G1 (G1 Drag coefficient, hereafter, "G1"). Within a certain time frame, the stagnation temperature on the tip of the projectile traveling 4,500 fps can exceed 1,651 degrees F. At 3,000 fps, the aerodynamic stagnation temperature on the tip of the projectile can be as high as 850 degrees F. At a velocity of 3,120 fps, the peak stagnation temperature can be 2.55 times the melting point of the crystalline polymer, DELRIN®, a common projectile tip material.

The "peak stagnation temperature" achieved during projectile flight is a function of velocity and BC which, together, determine the projectile's time of flight. Each projectile is different and peak stagnation temperature is greatly influenced by flight time during travel of a projectile through its particular zone of heating. In short, peak stagnation temperature can be hastened or delayed, and is dependent on a projectile's inherent aerodynamic efficiency and its initial velocity. With respect to time and distance, the HORNADY® tests show that it takes approximately 0.05 to 0.20 seconds, depending on the initial projectile velocity and the projectile's drag, for crystalline polymer tips to begin to deform and/or melt. Based on the flight time range cited above, crystalline polymer tip distortion begins to occur at flight distances of 50-200 yards. The Doppler radar data showed that distortion of the tip (of some unknown shape) continues for up to 500-600 yards, depending on the projectile's aerodynamic properties. The melting of the tip, or other heat-related distortion of the tip, causes the tip diameter (meplat diameter), to become large, which increases the aerodynamic drag on the projectile. The tip deformation manifested in the HORNADY® radar data was concluded based on an increase in the drag coefficient of the projectile at high velocities, which was then maintained for the remainder of the projectile's drag curve.

The most severe tip-heating problem is primarily associated with polymer-tipped projectiles having high BC's, especially those having a BC of 0.550 (G1 drag coefficient, hereafter, "G1") or greater. Generally speaking, polymer-tipped varmint projectiles and conventional, medium-BC (0.400 to 0.500 G1) projectiles are less affected because those projectiles do not typically experience high velocity for a period time sufficient to cause aerodynamic heating that significantly affects the tip. In the case of a medium-BC projectile at a very high velocity (e.g., 3,900-4,500 fps), the projectile experiences a substantially elevated stagnation temperature that, when coupled with increased supersonic airflow pressure acting on the projectile nose, can deform the tip of the projectile, and ultimately lowering the BC of the projectile.

Hornady's approach to minimizing tip deformation for a specific velocity range was to use more expensive polymer tips made from more exotic amorphous polymers such as Polyetherimide (PEI), Polyphenylsulfone (also known as polyphenylsulphone) (PPSU or PPSF), and Polysulfone (also known as polysulphone) (PSF). Unlike crystalline polymers, amorphous polymers do not have a discreet melting temperature. Amorphous polymers have a sharp glass transition temperature (Tg) but a broad temperature range as it relates to "liquefaction" ("the state of being liquid") which, for all practical purposes herein, can be construed to be the equivalent of melting temperature (Tm) relative to crystalline polymers. The reverse is the trend for crystalline polymers in that crystalline polymers have a narrow Tm and a less sharp Tg. Three of the amorphous polymers HORNADY® selected for use have higher Tg's and higher liquefaction temperatures than the typical crystalline polymers used for projectile tips such as DELRIN® and nylon 6,6, as well as the amorphous polymer, polycarbonate (PC). It should again be stressed, however, that amorphous resins lose their strength quickly above their Tg. This last point is important with respect to the material integrity limitations of even the most robust amorphous polymers available, since their Tg is much lower than their liquefaction temperature. This means that BC-reducing tip deformation can occur in amorphous polymer tips within relatively early flight, depending on BC and velocity, just as is the case with traditional, lower-cost crystalline polymer tips due to a tip-softening effect once Tg is reached.

Regardless of the polymer tip material used, the above projectile design did not solve the problem due to stagnation temperature, especially at launch velocities above 2,950 fps. Of the three amorphous polymer tip materials selected for use by HORNADY®, polyphenylsulfone (PPSU, PPSF) has the highest Tg and the highest liquefaction temperature. The other two amorphous polymers selected, polyetherimide (PEI) and polysulfone (PSF), exhibit lower glass transition temperatures and lower liquefaction temperatures, respectively. Thus, at a launch velocity of 2,950 fps, a high-BC projectile with a PPSU or PPSF amorphous tip exceeds not only its Tg of 428 degrees F. (the point at which the tip becomes rubber-like and can deform during projectile flight) but also its liquefaction temperature of 750 degrees F. (the point at which it becomes a liquid and permanently loses its shape). In short, at this velocity, the surface of the tip can begin to liquefy since the stagnation temperature at that speed is approximately 770 degrees F. With that in mind, it appears that Hornady's preferred material is PEI. With PEI, the tip deformation problem slightly increases since PEI has an even lower Tg (422.6 degrees F.) and an even lower liquefaction temperature (735.8 degrees F.). The third HORNADY® polymer, PSF, has a significantly lower Tg and liquefaction temperature than PEI. In any case, even though these amorphous polymers are more robust relative to temperature, the polymers ultimately suffer from the same tip deformation problem as crystalline polymers. For example, the tip-deformation problem caused by stagnation temperatures becomes much worse as muzzle velocity is increased above 2,950 fps. In particular, a projectile moving at 2,950 fps can experience a peak stagnation temperature of 1.13 times the liquefaction temperature of the amorphous polymer, such as PEI. In addition, high-ambient temperature conditions can further increase the peak stagnation temperature experienced by the projectile over the course of its flight, and thereby increasing tip deformation of the polymer-tipped projectile.

Figure 2:
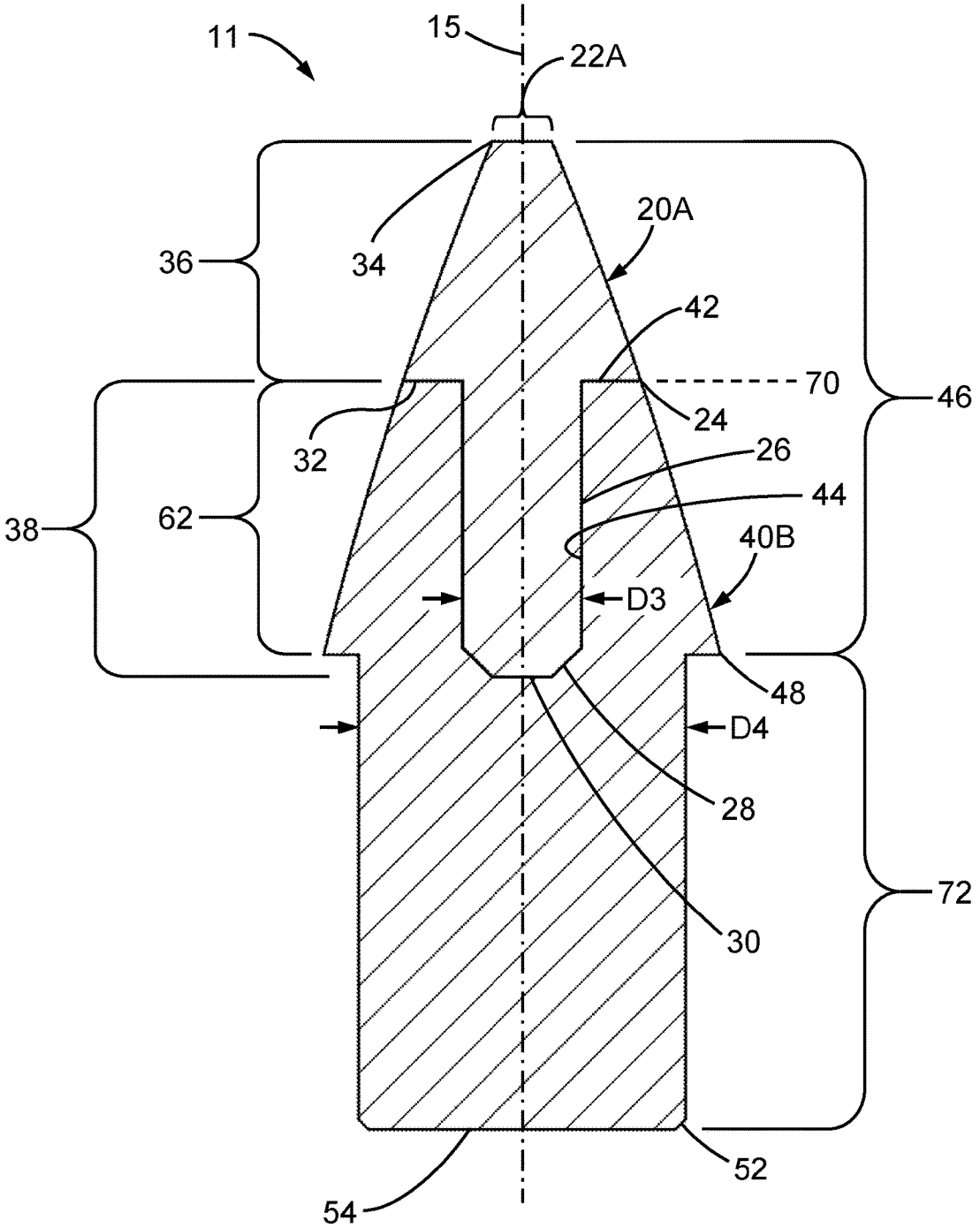
FIG. 2 is a longitudinal cross-sectional view of a nose insert for a projectile including a polymer nose element and a metal tip, in accordance with another embodiment of the present disclosure.
Figure 3:
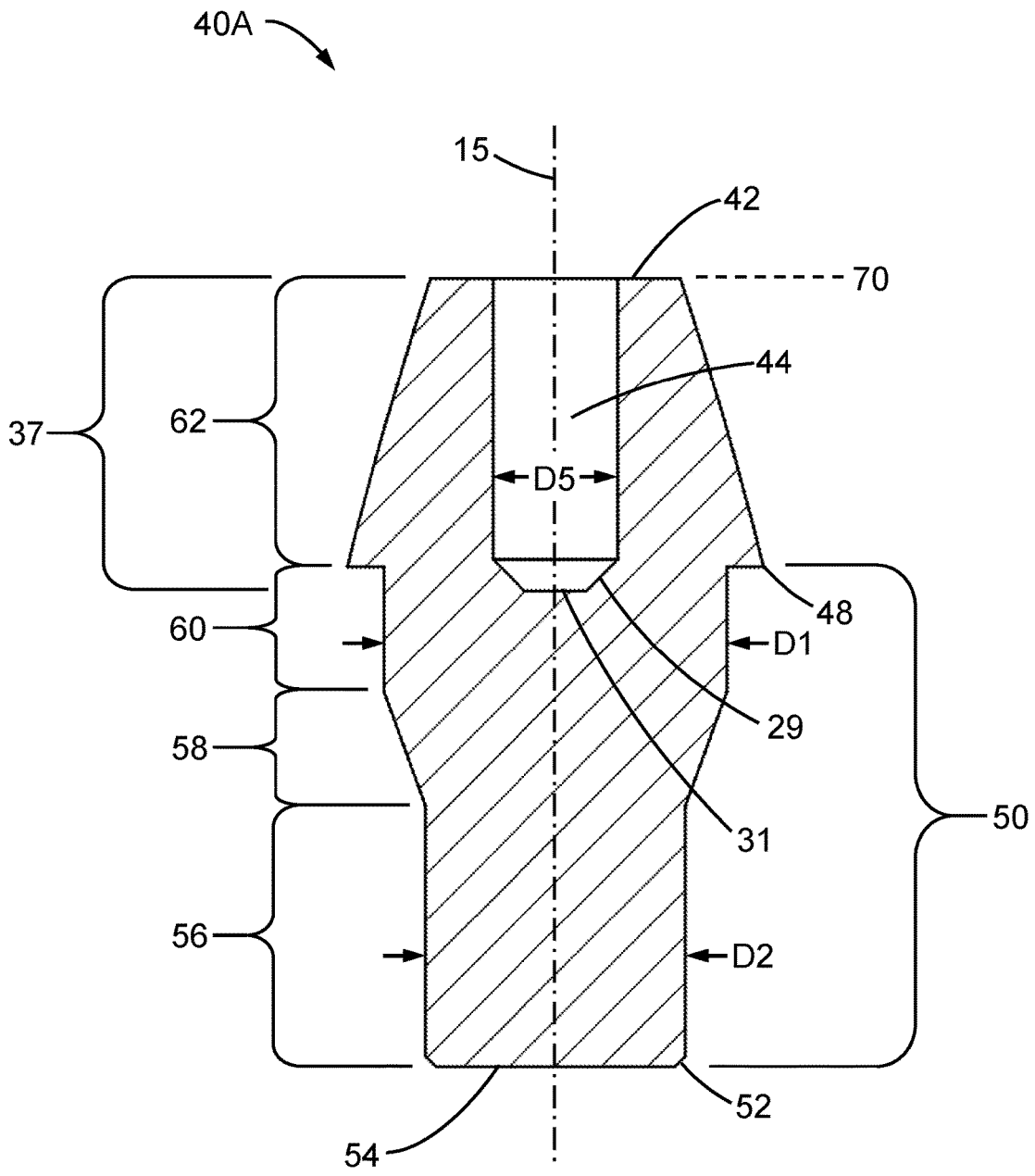
FIG. 3 is a longitudinal cross-sectional view of the polymer nose element of the nose insert shown in FIG. 1, in accordance with an embodiment of the present disclosure.

The FIG. 3 of the HORNADY® patent application shows a start velocity of Mach 2.5. Mach 2.5 is equivalent to 2,791.093 fps. While this graph shows a difference in drag between DELRIN® and PEI, the actual difference in drag and the corresponding difference in velocity between the two tip materials are not extreme. Regarding the HORNADY® test parameters described in its two publications, it is important to note that no launch velocity exceeding 3,000 fps (Mach 2.687) is mentioned. The highest Mach number reflected in FIG. 2 (Cd vs. Mach) of the HORNADY® technical article is approximately 2.63 (2,936.229 fps), and thus, is an indication that at higher velocities the more robust amorphous polymers will have exceeded their maximum velocity threshold with respect to shape retention of the tip and will no longer yield a meaningful BC advantage because the tip will have begun to liquefy. The scope of the amorphous tip deformation problem is underscored by the fact that modern hunting and target rifle cartridges typically produce velocities within the 2,800 to 3,200 fps range. With that in mind, the meplat area of an amorphous tip in a high-BC projectile is not going to survive velocities above 3,000 fps without experiencing degradation (e.g., deformation) since the stagnation temperature, according to the HORNADY® patent application, at this velocity is approximately 450 degrees Celsius (C). (842 degrees F.) which exceeds the limits of amorphous polymer integrity due to its 750-degree F. liquefaction temperature.

At this juncture, it should be noted that even though Doppler radar can record a projectile's drag and velocity at many points over the course of its flight (starting at about 50 yards downrange from the radar head), deformation of the polymer tip is not visible to the human eye. In light of that shortcoming, Doppler radar is, in a sense, "blind" technology. The only way polymer tip deformation of 0.025 of an inch or less can be clearly seen with sufficient resolution is with ultra-high-speed ballistic photography. Photographs showing detailed tip deformation can be obtained by employing an ultra-high-speed flash unit having a 500 nanosecond exposure time (or faster) and a high resolution digital camera of 24 megapixels (or greater) and equipped with a macro lens having a reproduction ratio of 1:1. Additionally, a high-speed trigger system having a response time (e.g., 1 microsecond) needs to be employed in order to trigger the flash in a timely manner as the projectile passes through the flash zone. Even with such equipment, the photographs are to be recorded at night or under extremely subdued light conditions at the actual projectile range (e.g., 200-1000 yards). High-speed photography of a polymer tip deforming or melting in flight, however, is difficult at extended ranges. In light of this, there is no concrete evidence regarding the degree to which polymer tips (whether crystalline or amorphous) deform in flight. All that is known as a result Hornady's Doppler radar tests is that a polymer tip in a high-BC projectile can be deformed to some unknown shape and degree once a certain velocity threshold is met or otherwise exceeded.

In light of the polymer tip shortcomings, a need exists for a new and improved nose insert for a projectile that withstands sustained high stagnation temperatures that occur over long-range projectile flight at speeds between 2,400 fps and 4,500 fps, while maintaining a high BC over the course of the projectile's travel. The various embodiments of the present disclosure fulfill this need.

The present disclosure provides an improved nose insert for use with a projectile comprising a polymer nose element containing a metal tip. In an example embodiment of the present disclosure, the nose insert includes a resilient polymer nose element or body with a forward-projecting metal tip to reduce long range aerodynamic drag caused by heat-related tip deformation during high-velocity flight over great distances. In addition, the nose insert also improves the characteristics of the projectile upon impact with a target at long range, for example by improving projectile expansion. The nose insert of the present disclosure provides a hybrid tip that outperforms conventional, single-material tips by eliminating all adverse tip deformation (e.g., melting) that occurs during flight of the projectile, as previously described herein. The nose insert includes an elongated polymer nose element and an elongated, pressed-in or molded-in (e.g., insert molded), protective metal tip. When assembled, the polymer nose element and metal tip remain in contact with one another, and together, form a single unit (a nose insert), the rear portion of which can be centrally secured in a jacket of the projectile, adjacent a portion of the projectile's ogive.

The polymer nose element or body can be a crystalline or amorphous polymer material comprising a tapered head portion containing a forward-central cavity (i.e., a blind hole) and a shank portion which has a smaller diameter (or diameters) than the greatest diameter of its tapered head portion. The largest width of the tapered head of the polymer nose element essentially forms a "shoulder", the underside of which lies along a plane that separates it (geometrically) from its shank portion. The forward most portion of the polymer nose element can terminate in a flat end which is preferably substantially perpendicular to its axis, as is its shoulder.

The metal tip can be manufactured from one of aluminum, aluminum alloy, copper, copper alloy, bronze, brass, mild steel or stainless steel or any metal having a sufficiently high melt temperature. In an example embodiment, the metal tip material is made from aluminum. The metal tip comprises a tapered end and a shank portion which has a smaller diameter than the largest diameter of its tapered end. The greatest width of the tapered end of the metal tip essentially forms a shoulder, the underside of which lies along a plane that separates it (geometrically) from its shank portion. The forward most portion of the metal tip (i.e., the meplat) can terminate in either a flat or a radius. In either case, the flat or radius, can be extremely small (i.e., forming a sharp point), which ultimately maximizes the BC of the projectile.

In another example embodiment of the present disclosure the nose insert is a two-component, heat-mitigating nose insert for use in a projectile capable of withstanding extremely high stagnation temperatures without melting comprising: a polymer nose element and a rigid metal tip wherein the polymer nose element is elongated and has a tapered head portion with a cylindrical central cavity and a cylindrical rear shank portion having a smaller diameter than the tapered head portion; and an elongated metal tip with a tapered head portion and a cylindrical rear shank portion having a smaller diameter than its tapered head portion wherein the cylindrical rear shank portion of the metal tip is received in and tightly held within the cylindrical central cavity of the polymer nose element; and a projectile containing the two-component, heat-mitigating nose insert.

In another example embodiment, the present disclosure also discloses a projectile that includes the nose insert, as described herein. In example embodiment in accordance with the present disclosure, the projectile includes a nose insert including a polymer nose element and a metal tip and further includes an elongated projectile body, the body having a forward end, the body having a rear end opposite the forward end, the body having an intermediate cylindrical portion between the rear and forward ends, the front end of the body defining a cavity, wherein at least a portion of the nose insert is received in the cavity.

Example Projectile and Nose Insert Configurations

FIG. 1 illustrates a longitudinal cross-sectional view of a nose insert 10 for a projectile including a polymer nose element 40A and a metal tip 20A, in accordance with an embodiment of the present disclosure. Generally speaking, the polymer nose element 40A can be manufactured from either a crystalline or amorphous polymer, for example by injection molding techniques. The size and shape of the polymer nose element 40A are both dependent on projectile caliber, ogive type (e.g., tangent or secant), and the ogive radius of the specific projectile to which the polymer nose element 40A is to be installed. For instance, the polymer nose element 40A, in some examples can include a curving or ogival tapered head portion 62, the radius of which matches that of the projectile ogive.

The polymer nose element 40A is configured to receive a metal tip 20A. In some examples, the polymer nose element 40A also includes a central cavity 44 configured to receive a portion of the metal tip 20A (e.g., shank portion 26), as described in more detail below. In some examples, the central cavity 44 is within at least a portion of the tapered head portion 62 of the polymer nose element 40A. In some other examples, the cavity 44 extends from a forward edge of the tapered head portion 62 and into the shank portion 50. Cavity 44, in yet other examples, is present within the tapered head portion 62 but does not extend into the shank portion 50. In such examples, the cavity 44 can extend approximately halfway along the length of the tapered head portion 62. In other examples, the cavity 44 can extend approximately an entire length of the tapered portion 62. In addition, the polymer nose element 40A can include a flat face 42 to receive a corresponding portion of the metal tip 20A (e.g., underside 32), as will be described further herein. In some examples, the flat face 42 is perpendicular to the central axis 15 of the polymer nose element 40A.

The polymer nose element 40A is further configured to be received within a jacket of a projectile so as to secure the nose insert 10 within the projectile, as described further below. The polymer nose element 40A, in some examples, further includes a shoulder 48 and a shank portion 50 configured to engage one or more surfaces of the jacket of a projectile. In particular, the shoulder 48 can be configured to mate or otherwise engage a rim of a jacket to form a projectile. The shoulder 48, in some examples, can also define a maximum width of the tapered head portion 62. In one example, the shoulder 48 is flat surface that is perpendicular to the central axis 15. The shoulder 48, in some examples, can be parallel to the flat face 42 at the forward end of the polymer nose element 40A. The shoulder 48, in some examples, can be inclined or otherwise tapered relative to the central axis 15 to receive an inclined surface profile of a rim of the jacket of the projectile.

The nose element 40A also includes a shank portion 50 that engages or otherwise attaches to a jacket of a projectile, as described further herein. Generally speaking, the shank portion 50 can have any size and/or shape so that the shank portion 50 can contact one or more internal surfaces of the jacket. In some examples, as can be seen in FIGS. 1 and 3, the shank portion 50 of the polymer nose element 40A is a dual-diameter shank that comprises three portions 60, 58 and 56, and includes two distinct diameters, D1 and D2. In more detail, the first shank portion 60 is adjacent to the shoulder 48 of the polymer nose element 40A and includes shank diameter D1. Continuing rearward, the next portion 58 of the shank portion 50 consists of a tapered portion which connects the diameter D1 of the shank portion 50 with the rearmost portion 56 of the shank portion 50 which has a smaller shank diameter D2 than shank diameter D1. A chamfer 52, or a radius (not shown) can exist at the rear 54 of the polymer nose element 40A, which assists in guiding and centering the polymer nose element 40A (or the assembled nose insert 10) into a central cavity that exists within the core 92 of the projectiles 100A-100D as shown in FIGS. 5-8, respectively. The shank portion 50, in some other examples, can include a cylindrical or rectangular cross-sectional shape, and include uniform dimensions (e.g., a diameter). Numerous other polymer nose elements configurations will be apparent from the present disclosure.

The nose insert 10 further includes a metal tip 20A configured to reduce aerodynamic drag caused by heat-related tip deformation. In more detail, the metal tip 20A has a much higher melt temperature than polymer materials used in previous designs. When used for its intended purpose as expressed herein, the metal tip 20A does not deform or otherwise melt in response to high stagnation temperatures present during high-speed flight. The high melting temperature of the metal tip 20A ensures that a high projectile BC is maintained over the entire course of the flight of the projectile. In addition, the underside 32 of shoulder 24, which lies along a plane 70 perpendicular to the central axis 15 of the nose insert 10, shields and thereby protects the underlying flat face 42 of the polymer nose element 40A from melting and/or other heat-related deformation. As can be seen in FIG. 1, the metal tip 20A is installed or otherwise held in place within the central cavity 44 of the polymer nose element 40A. The shank portion 26 of the metal tip 20A can be mechanically pressed into or molded into the tapered head portion 62 of the polymer nose element 40A. In some examples, the metal tip 20A includes a meplat 22A at the forward terminus 34 of the metal tip 20A, a shoulder 24, and a shank portion 26. Depending on the application, the axial height 38 of the shank portion 26 of the metal tip 20A may be less than, equal to, or greater than the axial height of the tapered head portion 62 of the polymer nose element 40A.

The metal tip 20A can be manufactured from a variety of metallic materials that do not deform or otherwise melt in response to high stagnation temperatures present during high-speed flight of the projectile. In general sense, note that the metal tip 20A is small in size, and thus thousands of parts can be made from one pound of low-cost metal, such as aluminum. Depending on the style of the metal tip 20A, between about 4,000 and 8,000 metal tip components can be produced from one pound of aluminum wire. The metal tip 20A can be manufactured from aluminum, in some examples, due to its low cost, light weight, malleability and relatively high melt temperature. The metal tip 20A, in other examples, can be manufactured from bronze, brass, copper (or alloys thereof), or mild steel or stainless steel. While the metal tip 20A can be produced by machining, other methods of manufacture, such as cold forming by swaging the metal, can be a faster process and much less expensive. In more detail, swaging is a low cost and high production rate process, wherein a short length of wire, preferably aluminum wire, is placed in a two-piece die having controllable clamping force and then cold formed under pressure. In addition, the swaging can produce a metal tip 20A having an exterior finish that is far smoother than a machined part. In short, the metal tip 20A can be molded, machined, or swaged to any desired shape using any suitably malleable metal having a suitably high melt temperature.

If the shank portion 26 of the metal tip 20A is mechanically pressed into the tapered head portion 62 of the polymer nose element 40A (versus being insert molded in place), the diameter D3 of the shank portion 26 of the metal tip 20A can be between about 0.001 of an inch and 0.005 of an inch larger in diameter than the inside diameter of the central cavity 44. As a result, the radial contact or interference between components results in a tight, friction fit which prevents the shank portion 26 of the metal tip 20A from dislodging or shifting position within the polymer nose element 40A caused by vibration and/or or inertial forces associated with firearm recoil. If the metal tip 20A is press-fitted into position within the central cavity 44 of the polymer nose element 40A, the underside 32 of the shoulder 24 of the metal tip 20A and the flat face 42 of the polymer nose element 40A meet and remain in contact with one another. After the two components are attached to one another, either mechanically or by way of insert molding, the tapered head portions, 36 and 62, form and share a common ogive radius 46 which closely matches the ogive radius of the projectile in which the nose insert 10 will ultimately reside. This arrangement results in a relatively smooth and continuous curvature between components. In addition, in some examples, the rear 30 of the shank portion 26 can include a chamfer 28 or a radius (not shown), which assists in guiding and centering the shank portion 26 into the cavity 44 of the polymer nose element 40A. Alternatively, the metal tip 20A can be inserted in the central cavity 44 of the tapered head portion 62 of the polymer nose element 40A after the shank portion 50 of the polymer nose element 40A is secured within a central cavity in the core of a projectile. Numerous other ways of assembling the nose insert and projectile will be apparent from the present disclosure.

The metal tip 20A, in some examples, includes a size and shape that are both dependent on projectile caliber, ogive type (tangent or secant), and the ogive radius of the specific projectile to which the metal tip 20A is to be installed. For instance, the metal tip 20A includes a curving or ogival tapered head portion 36, the radius of which matches that of a jacket of the projectile and a radius of the tapered head portion 62 of the polymer nose element 40A. In other words, the tapered head portion 62 of the polymer nose element 40A and the tapered head portion 36 of the metal tip 20A essentially share a common radius which results in a relatively smooth and continuous curvature between components. In addition, the general shape and features of the metal tip 20A are described further below with regard to FIGS. 2-8.

TABLE 1

Melt points of metals, melt points, liquefaction points and glass transition points of polymers

| Metal | Melting Point | |
|---|---|---|
| stainless steel | 2750° F. | — |
| mild steel | 2600° F. | — |
| copper | 1983° F. | — |
| brass | 1710° F. | — |
| bronze | 1675° F. | — |
| aluminum | 1220° F. | — |
| **Polymer** | **Liquefaction Point, Melting Point** | **Glass Transition Point** |
| PEI | 736° F. | 422.6° F. |
| nylon 6,6 | 509° F. | 296.6° F. |
| Delrin ® | 335° F. | −76° F. |
| PC | 311° F. | 122° F. |

Table 1 shows the melting points of various metals, the melting points of two crystalline polymers, the liquefaction points of two amorphous polymers, and the glass transition temperature Tg of the four polymers cited herein. It will become readily apparent from viewing Table 1, as well as the graph shown in FIG. 9, that even the metal with the lowest melt point shown (aluminum), has a very great advantage over all of the polymer types listed, including PEI, with respect to melt temperature. The melt point of aluminum is 1220 degrees F. whereas the liquefaction point of PEI is 736 degrees F. The temperature differences shown in Table 1 are important with respect to the effect stagnation temperature has on these two materials. PEI will liquefy at less than 3,000 fps whereas aluminum will withstand a velocity of over 3,800 fps before melting. PEI will also exhibit soft, rubbery deformation properties at only 422.6 degrees F. It should be understood that a high-BC projectile can achieve a stagnation temperature of 422.6 degrees F. at a velocity of only 2,200 fps. This means that PEI can deform in flight at higher velocities as a result of its Tg. With respect to achievable stagnation temperatures, it should likewise be understood that no high-BC projectile available can melt an aluminum tip since such projectiles are long and heavy and therefore cannot move at a velocity of 3,800 fps. If the metal tip 20A is made of copper, low and medium-BC projectiles could travel at nearly 4,950 feet per second without melting. If the metal tip 20A is made of stainless steel, low or medium-BC projectiles could travel at over 5,900 feet per second without melting.

FIG. 2 illustrates a longitudinal cross-sectional view of a nose insert 11 for a projectile including a polymer nose element 40B and a metal tip 20A, in accordance with another embodiment of the present disclosure. The metal tip 20A has been previously described in relation to FIG. 1. Furthermore, many of the features of the polymer nose element 40B have been previously described in relation to nose element 40A shown in FIG. 1. As can be seen, the polymer nose element 40B, however, includes a shank portion 72 instead of a dual diameter shank portion 50 of the element 40A of the nose insert 10. The shank portion 72, in some examples, is cylindrical in shape and has the same diameter D4 over its entire length, except for a chamfer 52 or a radius (not shown) at the rear 54 of the shank portion 72 of the polymer nose element 40B. As a result of its uniform shape, the cylindrical shank portion 72 allows lower velocity projectiles to expand or mushroom more readily upon impact at extended ranges because the nose element 40B includes more material in which to cause expansion of the projectile.

FIG. 3 illustrates a longitudinal cross-sectional view of the polymer nose element 40A of the nose insert 10, in accordance with an embodiment of the present disclosure. In an example embodiment, the nose element 40A includes inside diameter D5 of the central cavity 44 that is smaller than the outside diameter D3 of the shank portion 26 of the metal tip 20A, such as when the metal tip is mechanically inserted. In other embodiments, for example, if the nose insert 10 is insert molded, the inside diameter D5 of the central cavity 44 of the polymer nose element 40A and the outside diameter D3 of the shank portion 26 of the metal tip 20A can be substantially the same. The axial depth 37 of the central cavity 44 can be less than, equal to, or greater than the axial height of the polymer tapered head portion 62 of the polymer nose element 40A. The shape 29 near the terminus 31 of the central cavity 44 can be frusto-conical or spherical, conical or cylindrical. In addition, the central cavity 44 allows manufacture of the polymer nose element 40A with less polymer material than required for solid (conventional) polymer tips, and thereby reduces manufacturing costs. While the polymer nose element 40A can be injection molded using any crystalline or amorphous polymer, crystalline polymers, such as DELRIN®, are preferred as they are less expensive than amorphous polymers, such as PEI. It should be noted that the current cost of PEI per pound is $8.80 versus the current cost of DELRIN® of $1.39 per pound. The difference in cost between the polymer types and the metals cited herein can be found in Table 3 provided herein.

Figure 4:
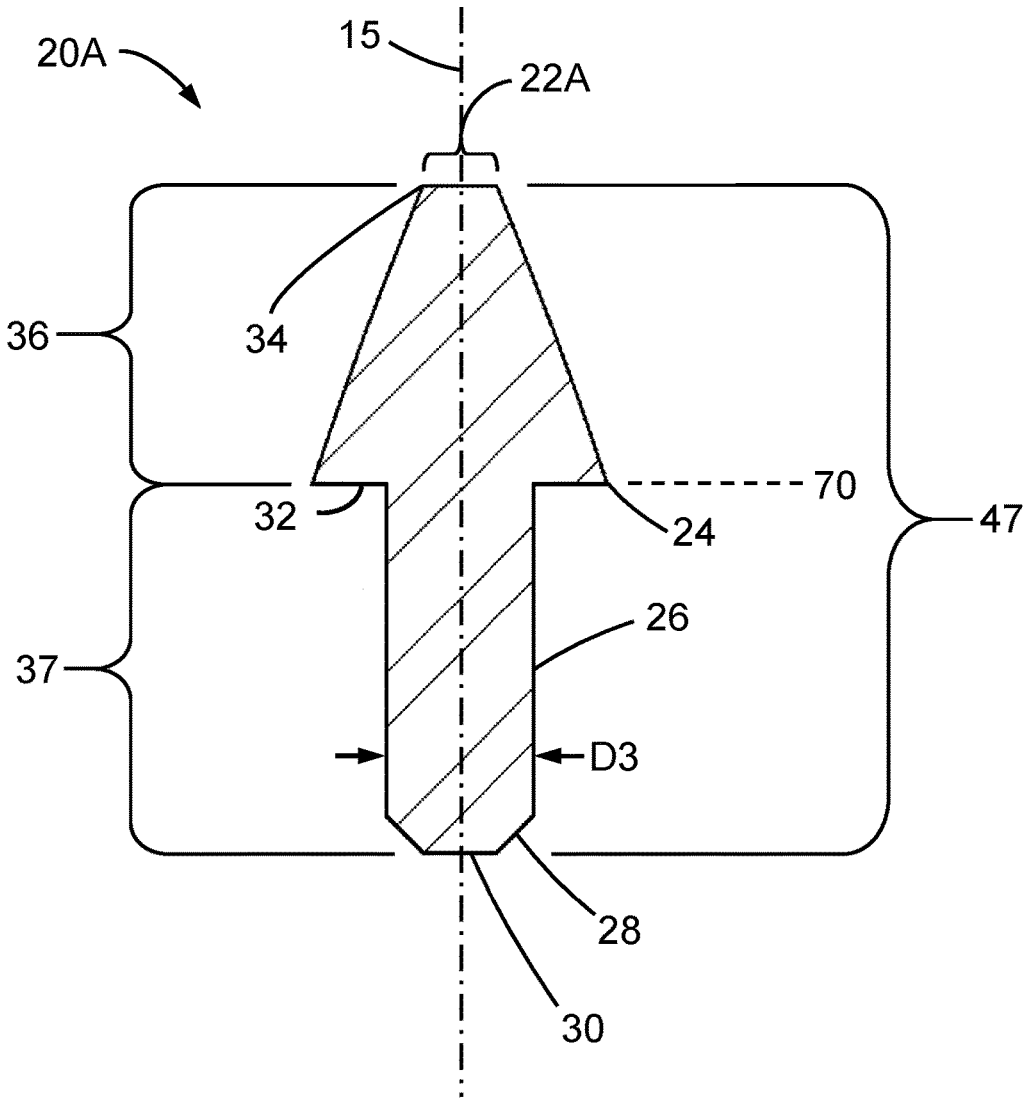
FIG. 4 is a longitudinal cross-sectional view of the metal tip of the nose insert shown in FIGS. 1-2, in accordance with an embodiment of the present disclosure.
Figure 6:
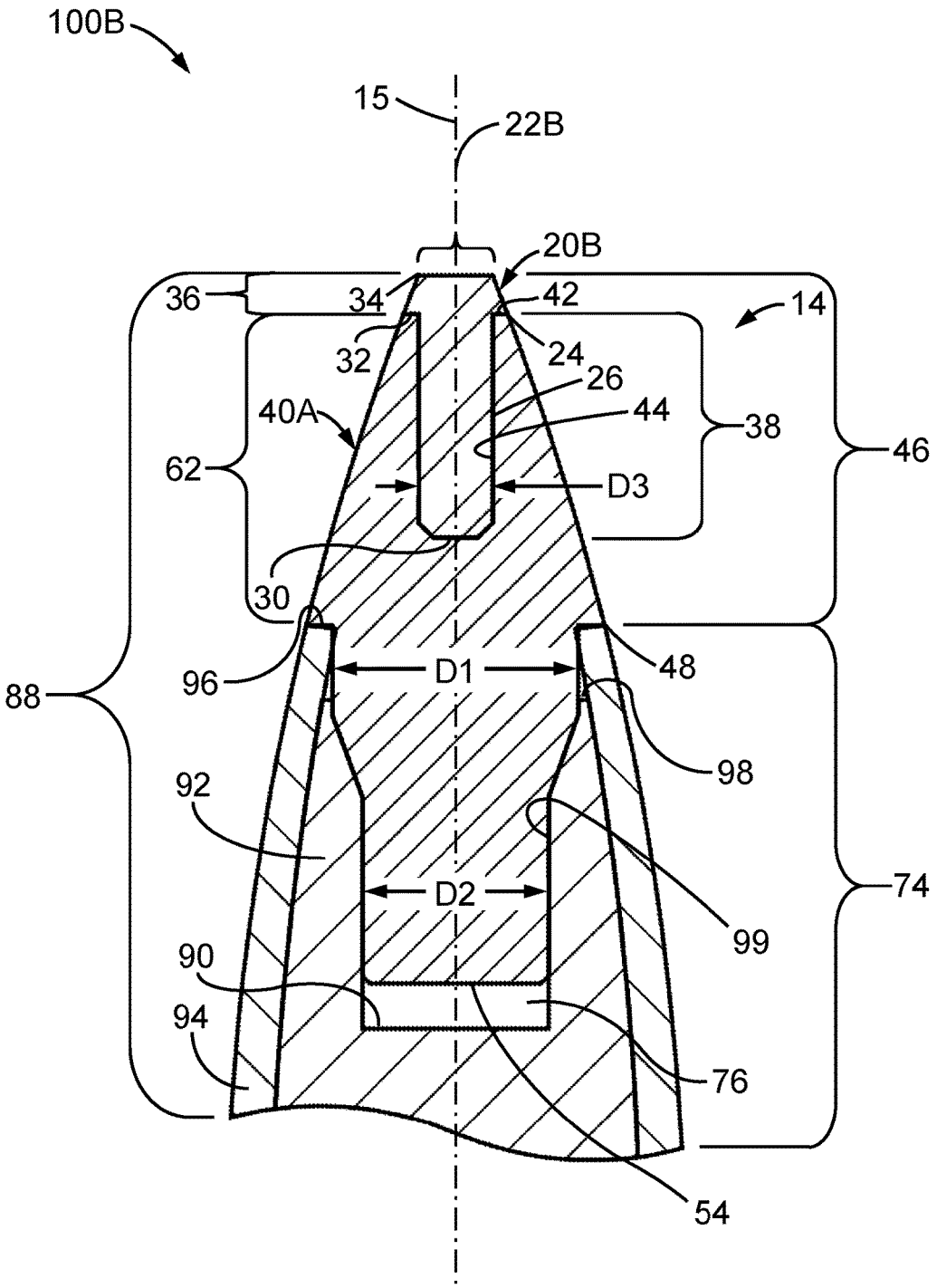
FIG. 6 is a partial longitudinal cross-sectional view of a projectile that includes a nose insert in accordance with another embodiment of the present disclosure.
Figure 8:
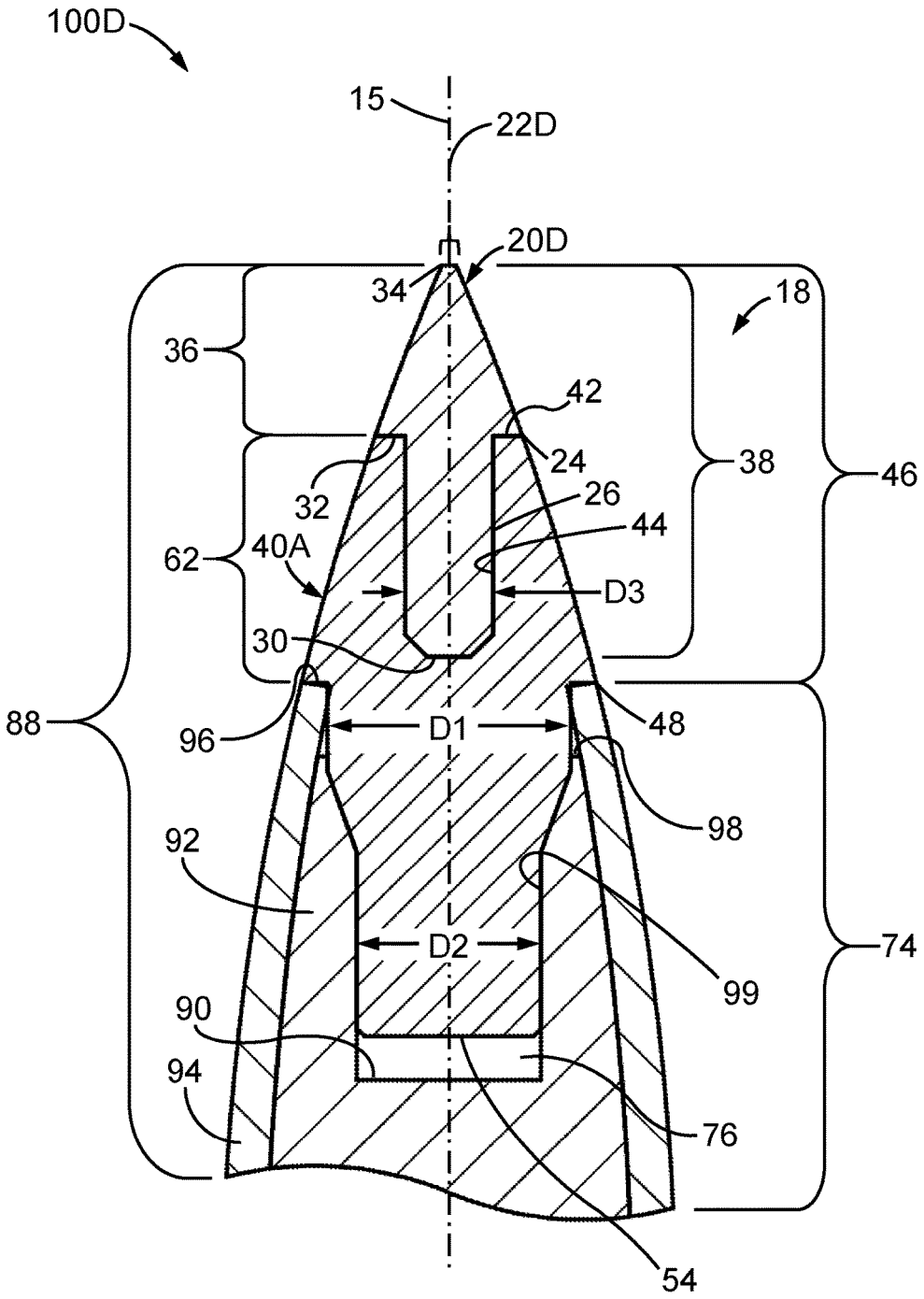
FIG. 8 is a partial longitudinal cross-sectional view of a projectile that includes a nose insert in accordance with another embodiment of the present disclosure.

FIG. 4 illustrates a longitudinal cross-sectional view of the metal tip 20A of the nose inserts 10 and 11, in accordance with an embodiment of the present disclosure. In a general sense, the metal tip 20A can assume various shapes and sizes, depending on the desired projectile type. For instance, the diameter D3 of the shank portion 26, the axial depth 37 of the shank portion 26, the axial height of the tapered head portion 36, the lateral width of the shoulder 24, the diameter of the meplat 22A, and the overall length 47 of the metal tip 20A can all vary, dimensionally. In particular, the diameter of the meplat 22A can be very small (e.g., 0.010 inch or smaller) as depicted in FIG. 8, or as wide as 0.060 of an inch or wider as generally depicted in FIG. 6. In more detail, the diameter of the meplat 22A can affect ballistic characteristics of the projectile. For example, the smaller the meplat 22A diameter (i.e., the more sharply pointed the metal tip 20A), the higher the BC of the projectile. Maintaining a sharp point at the tip of a projectile in flight can improve projectile performance. Unlike an all-polymer tip, the size of the meplat 22A in the metal tip 20A can be virtually any diameter (e.g., extremely pointed) and still resist tip-flattening deformation under recoil when contained in the magazine box of a firearm because metal materials have greater hardness than plastic materials. The sharpness of the meplat 22A of the metal tip 20A can be preserved and unaffected during assembly by using a seating punch having a central cavity which prevents the meplat 22A from ever contacting the seating punch itself. Furthermore, the metal tip may be anodized, dyed or colored using any process or means available.

TABLE 2

The Effect Meplat Diameter Has On BC

| 165 Grain 30 Caliber Projectile (6-S Tangent Ogive) | Meplat Diameter | BC |
|---|---|---|
| Example 1 | .091 | 0.3593 |
| Example 2 | .081 | 0.369 |
| Example 3 | .071 | 0.378 |
| Example 4 | .061 | 0.3862 |
| Example 5 | .051 | 0.3934 |
| Example 6 | .041 | 0.3995 |
| Example 7 | .031 | 0.4045 |
| Example 8 | .021 | 0.4081 |
| Example 9 | .011 | 0.4104 |
| Example 10 | .001 | 0.4112 |

Table 2 shows the effect that meplat diameter has on BC. Specifically, it shows how the BC of a 30 caliber, 165 grain, flat-based projectile having a 6-S tangent ogive can be raised by reducing the size of the meplat in 0.010 inch increments. A 6-S tangent ogive is a rather modest profile in a projectile of this caliber and weight, which is to say that it does not have inherently high BC potential. Even in light of the 6-S ogive limitation, however, a significant difference in BC of 0.0519 results by reducing the meplat diameter from 0.091 to 0.001 of an inch. This is a BC increase of nearly 14.5 percent. On the other end of the BC spectrum, when a very small meplat (e.g., between 0.001 and 0.010 of an inch) is used in conjunction with a long, heavy projectile having a very sharp secant ogive and a boat tail, the BC can be improved to a very pronounced and meaningful degree.

TABLE 3

Price Comparison; Metals Versus Polymers

| | Price Per pound |
|---|---|
| Metal | |
| bronze | $2.91 |
| copper | $2.48 |
| brass | $2.08 |
| stainless steel | $ .97 |
| aluminum | $ .78 |
| mild steel | $ .14 |
| Polymer | |
| PEI | $8.80 |
| PC | $1.60 |

TABLE 3-continued

| Price Comparison; Metals Versus Polymers | |
|---|---|
| | Price Per pound |
| nylon 6,6 | $1.41 |
| Delrin ® | $1.39 |

Table 3 shows the price per pound difference between both metals and polymers. The most salient comparisons with respect to the present disclosure are the low cost per pound of aluminum and DELRIN® versus the high cost of PEI.

Figure 5:
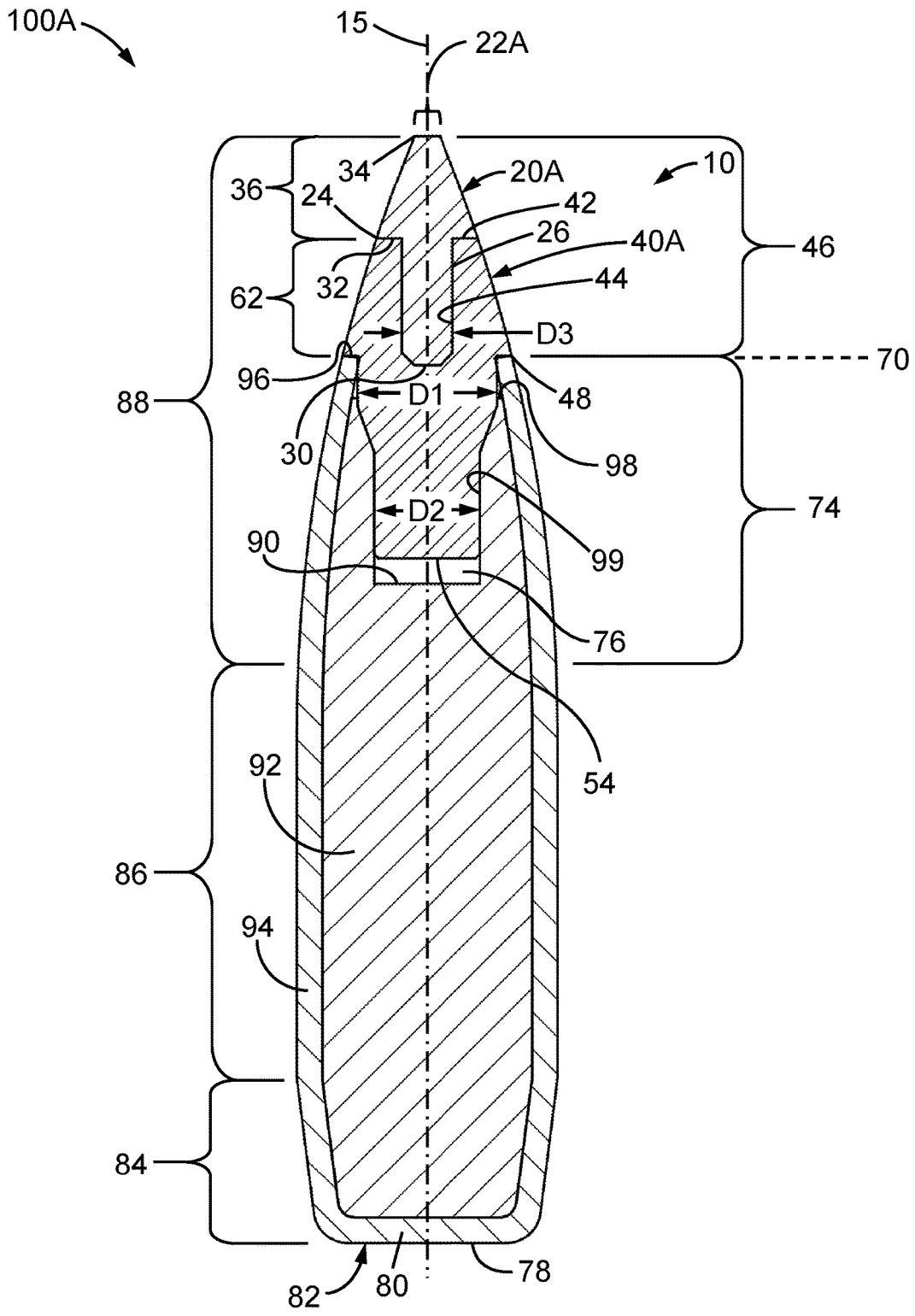
FIG. 5 is a longitudinal cross-sectional view of a projectile including a nose insert and a jacket, in accordance with an embodiment of the present disclosure.

FIG. 5 illustrates a longitudinal cross-sectional view of a projectile 100A including a nose insert 10 and a jacket 82 in accordance with an embodiment of the present disclosure. As can be seen, the projectile 100A includes a meplat 22A that can be used for both hunting and target shooting. It should be understood that the meplat 22A can comprise a flat or a spherical surface and can be of any size desired.

The projectile 100A is a generally cylindrical body, symmetrical in rotation about a central axis 15, with a rear end 78 and ends at the forward terminus 34 of the metal tip 20A. The projectile 100A has an exterior surface shaped as follows: a rear portion 84 has a tapered frusto-conical "boat tail" surface; a cylindrical intermediate portion 86 continues forward from the rear portion with a straight cylindrical side wall. Continuing, a forward ogive surface portion 88 has a gentle curve toward the meplat 22A of the metal tip 20A which includes the curvature of the ogive 74 of the jacket 82 (hereafter "jacket ogive"), the curvature of the tapered head portion 62 of the polymer nose element 40A, and the curvature of the tapered head portion 36 of the metal tip 20A. If the meplat 22A has a flat surface as shown in FIG. 5, the three curved portions of the projectile (the jacket ogive 74, the curvature of the tapered head portion 62 of the polymer nose element 40A and the curvature of the tapered head portion 36 of the metal tip 20A) share a common radius and are all collectively part of the forward ogive surface portion 88. If, on the other hand, the meplat 22A has a spherical surface, the meplat 22A curvature will define a much smaller radius at its forward terminus 34 than that of the three larger curved portions which collectively define the projectile's forward ogive surface portion 88. A spherical meplat configuration results in two radii (blended radii) in the tapered head portion 36 of the metal tip 20A at its forward terminus 34 as shown generally in FIG. 7. It should be noted that if the meplat 22A has a spherical surface, its radius can be 0.010 of an inch or smaller if desired. Regardless of the meplat geometry, the three larger curved portions of the projectile collectively result in a relatively smooth and continuous curvature between adjoining components and all contribute to forming the basic profile of the forward ogive surface portion 88. While a tangent ogive is shown in FIG. 5, the projectile 100A (as well as the projectiles 100B-D shown in FIGS. 6-8) can utilize either a tangent ogive or a secant ogive. A secant ogive has the potential to increase the BC of the projectile due to a sharper profile and may be preferable for extremely long-range shooting. It should also be understood that while a BC-enhancing boat tail is shown, a projectile utilizing the nose insert of the present disclosure can have a flat base without departing from the scope or spirit of the disclosure.

The projectile 100A is formed of a copper or copper alloy jacket 82 having a base portion 80, with side walls 94 extending forward to a rim 96 at a forward position on the jacket ogive 74 of the jacket 82. The jacket 82 surrounds a lead or lead alloy core 92 that defines a cylindrical cavity 99 in a forward face 98 of the core. The forward face 98 is rearward of the jacket edge or rim 96 in this particular embodiment, and the cylindrical cavity 99 is concentric with the central axis 15. The jacket rim 96 tightly grips the larger shank diameter D1 of the polymer shank portion 50 at the shoulder 48 to centrally secure the nose insert 10 into the projectile 100A adjacent a portion of the jacket ogive 74. A central air space 76 can exist within the core 92. The central air space 76 can be of any size and shape and can exist between the rear 54 of the shank portion 50 of the polymer nose element 40A and the bottom 90 of the cylindrical cavity 99. The purpose of the central air space 76 is to help facilitate projectile expansion as the nose insert 10 is driven rearward into the core 92 upon impact with a target, for example a fluid-based target.

FIG. 6 illustrates a partial longitudinal cross-sectional view of a projectile 100B that includes a nose insert 14 in accordance with an embodiment of the present disclosure. As can be seen, part of the forward ogive surface portion 88 is depicted from the full-length projectile view of FIG. 5. In this one example, the nose insert 14 includes a metal tip 20B and polymer nose element 40A. The polymer nose insert 40A has been previously described in relation to FIGS. 1 and 3. In addition, many of the features of the metal tip 20B have been previously described in relation to metal tip 20A shown in FIGS. 1 and 4. As can be seen, the meplat 22B of the metal tip 20B is flat, its width is than greater than the meplat 22A of FIG. 5, its shoulder 24 is narrower, its tapered head portion 36 is substantially shorter, the diameter D3 of its shank portion 26 is smaller and the axial height 38 of its shank portion 26 is reduced. The differences in shape and size described above result in a large reduction in volume of the metal tip 20B, which in turn provides an advantage in its manufacture. As many as 8,000 metal tips 20B of this size and style can be produced from one pound of low-cost aluminum wire, for example. Certain portions of the polymer nose element 40A may need to be resized and/or reshaped to accommodate the size and shape of the metal tip 20B to provide a smooth transition between components. Examples of this would include resizing the radius of the tapered head portion 62 of the polymer nose element 40A and the width of its flat face 42. This holds true for all of the embodiments shown in FIGS. 5-8.

Figure 7:
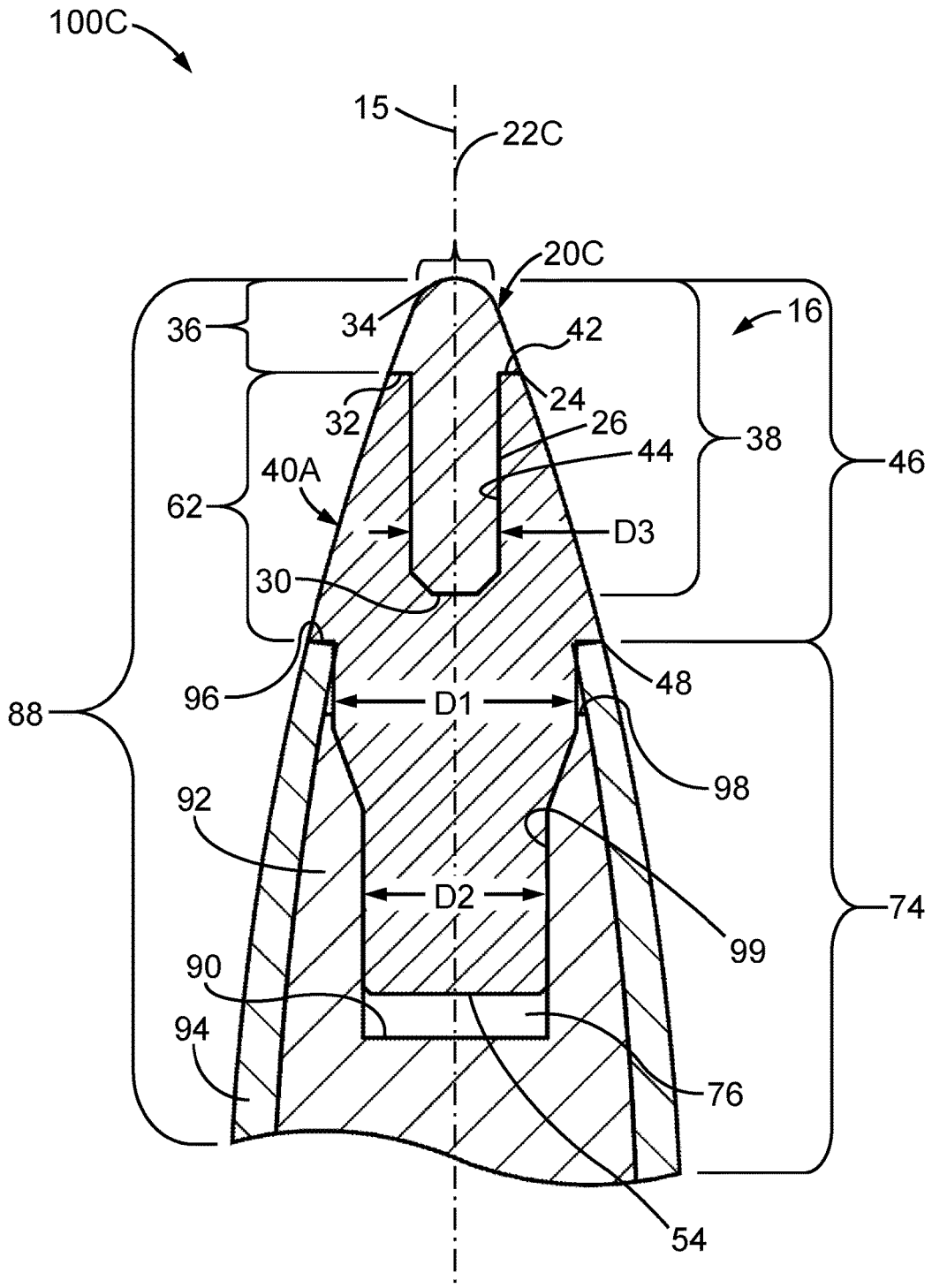
FIG. 7 is a partial longitudinal cross-sectional view of a projectile that includes a nose insert in accordance with another embodiment of the present disclosure.

FIG. 7 illustrates a partial longitudinal cross-sectional view a projectile 100C that includes a nose insert 16 in accordance with another embodiment of the present disclosure. In this one example, the nose insert 16 includes a metal tip 20C and polymer nose element 40A. The polymer nose insert 40A has been previously described in relation to FIGS. 1 and 3. In addition, many of the features of the metal tip 20C have been previously described in relation to metal tip 20A shown in FIGS. 1 and 4. The nose insert 16, however, includes components with a different size and shape as compared to those shown in FIG. 5. For instance, the meplat 22C of the metal tip 20C is rounded versus flat. In addition, the radius of meplat 22C is greater than the width of the meplat 22A shown in FIG. 5, its shoulder 24 is narrower, its tapered head portion 36 is shorter, the diameter D3 of its shank portion 26 is substantially the same, as is the axial height 38 of its shank portion 26. Generally speaking, the metal tip 20C depicted here is shown in a much larger size so that more detail in the tapered head portion of the metal tip 20C can be seen, especially with regard to its axial height. It should be understood that the actual size of the radius defining the rounded metal tip 20C can be 0.010 of an inch or smaller if desired, which would increase the BC of a projectile.

FIG. 8 illustrates a partial longitudinal cross-sectional view of a projectile 100D that includes a nose insert 18 in accordance with another embodiment of the present disclosure. In this one example, the nose insert 18 includes a metal tip 20D and polymer nose element 40A. The polymer nose insert 40A has been previously described in relation to FIGS. 1 and 3. In addition, many of the features of the metal tip 20D have been previously described in relation to metal tip 20A shown in FIGS. 1 and 4. However, the nose insert 18, in this one example, includes components with a different size and shape as compared to previous examples. For instance, the meplat 22D of the metal tip 20D is flat but its width is much narrower than the width of the meplat 22A shown in FIG. 5, its shoulder 24 is narrower, its tapered head portion 36 is longer, the diameter D3 of its shank portion 26 is substantially the same, as is the axial height 38 of its shank portion 26. The meplat 22D width as shown is approximately 0.010 of an inch which would nearly maximize the BC of a projectile provided by the ogive 88. The width of the meplat 22D can be as small as 0.001 inch. The very sharply pointed tip configuration shown in this embodiment would provide high velocity retention and a flat flight trajectory for target shooting or hunting at extreme ranges.

Figure 9:
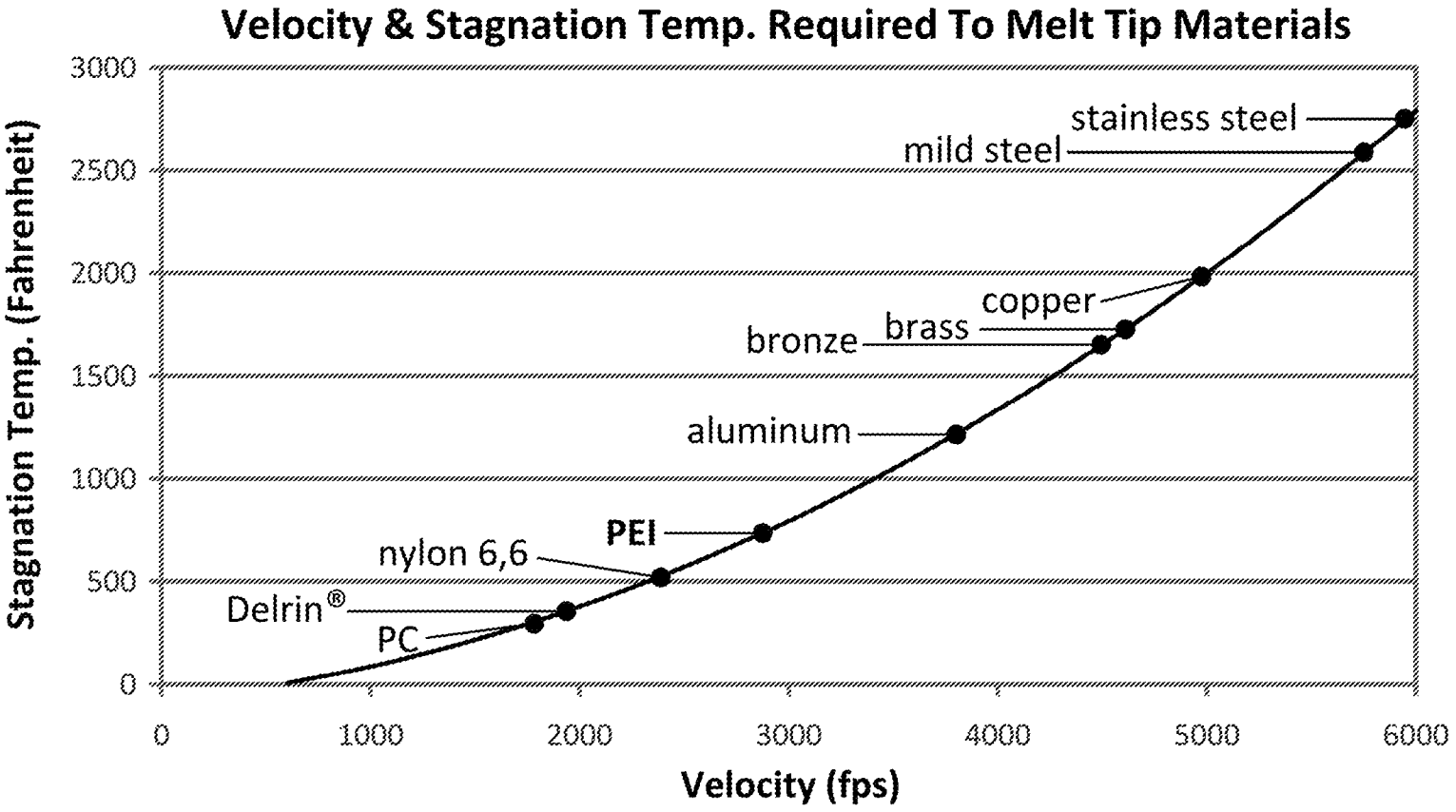
FIG. 9 is a graph illustrating stagnation temperatures relative to projectile velocity for various materials of a tip of the projectile, in accordance with an embodiment of the present disclosure.

FIG. 9 is a graph illustrating stagnation temperatures relative to projectile velocity for various materials used to form a tip of the projectile, in accordance with an embodiment of the present disclosure. The graph depicts the velocity required to achieve stagnation temperatures capable of melting or liquefying polymers currently used in all polymer projectile tips, as well as the velocity required to achieve stagnation temperatures capable of melting six metals that can be used to form the metal tip component of the present disclosure.

The embodiments of the disclosure and the various features thereof are explained in detail with reference to the non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings unless otherwise noted.

It is understood that the disclosure is not limited to the particular methodology, devices, apparatus, materials, applications, etc., described herein, as these may vary. It is also to be understood that the terminology used herein is used for the purpose of describing particular embodiments only, and is not intended to limit the scope of the disclosure. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this disclosure belongs. Preferred methods, devices, and materials are described, although any methods and materials similar or equivalent to those described herein can be used in the practice or testing of the disclosure.

Still further, the corresponding structures, materials, acts, and equivalents of all means plus function elements in any claims below are intended to include any structure, material, or acts for performing the function in combination with other claim elements as specifically claimed.

Those skilled in the art will appreciate that many modifications to the embodiments are possible without departing from the scope of the disclosure. In addition, it is possible to use some of the features of the embodiments described without the corresponding use of the other features. Accordingly, the foregoing description of the exemplary embodiments is provided for the purpose of illustrating the principle of the disclosure, and not in limitation thereof, since the scope of the disclosure is defined solely be the appended claims.

What is claimed is:

1. A nose insert for use in a projectile comprising:

a polymer nose element including a tapered head portion and a first shank portion attached to the tapered head portion, the tapered head portion includes a cavity disposed therein, and the first shank portion includes a first diameter smaller than a width of the tapered head portion adjacent to the first shank portion; and a metal tip disposed in the tapered head portion of the polymer nose element, the metal tip includes a tapered end and a second shank portion attached to the tapered end, and the second shank portion having a second diameter smaller than a width of the tapered end adjacent to the second shank portion, wherein the second shank portion is received in the cavity within the tapered head portion of the polymer nose element.

2. The nose insert of claim 1, wherein a largest width of the tapered head portion of the polymer nose element forms a shoulder in a plane perpendicular to an axis of the polymer nose element.

3. The nose insert of claim 1, wherein the tapered head portion of the polymer nose element is ogival in shape and terminates in a flat face at a forward end of the polymer nose element.

4. The nose insert of claim 1, wherein the tapered end of the metal tip is ogival in shape and terminates in a meplat at a forward end of the metal tip.

5. The nose insert of claim 1, wherein an ogive radius for an outer surface profile of the tapered head portion of the polymer nose element and an outer surface profile of a tapered point of the metal tip are the same.

6. The nose insert of claim 1, wherein the second diameter of the second shank portion of the metal tip is larger than an inside diameter of the cavity of the polymer nose element.

7. The nose insert of claim 1, wherein the metal tip is made from one of aluminum, aluminum alloy copper, a copper alloy, bronze, brass, mild steel, stainless steel or any metal having a melt temperature of at least 1200 degrees F.

8. The nose insert of claim 1, wherein the metal tip can withstand stagnation temperatures of between 1,200 and 2,700 degrees F. during flight of the projectile without deformation of the nose insert.

9. The nose insert of claim 1, wherein a largest width of the tapered end of the metal tip forms a shoulder in a plane perpendicular to an axis of the metal tip.

10. The nose insert of claim 9, wherein the shoulder of the metal tip includes an underside in contact with a flat face of the polymer nose element.

11. The nose insert of claim 1, wherein the second shank portion of the metal tip is in contact with a bottom surface of the cavity of the polymer nose element.

12. A projectile comprising:

a unitary body including a first end and a second end, the first end including a first cavity; and a nose insert disposed in the unitary body, the nose insert comprising a polymer nose element disposed within the unitary body, the polymer nose element including a tapered head portion and a first shank portion attached to the tapered head portion, the tapered head portion includes a second cavity disposed therein, and the first shank portion includes a first diameter smaller than a width of the tapered head portion adjacent to the first shank portion, wherein the first shank portion is received in the first cavity of the unitary body, and a metal tip disposed in the tapered head portion of the polymer nose element, the metal tip includes a tapered end and a second shank portion attached to the tapered end, the second shank portion having a second diameter smaller than a width of the metal tip adjacent to the second shank portion, wherein the second shank portion is received in the second cavity within the tapered head portion of the polymer nose element.

13. The projectile of claim 12, further comprising an ogive radius for each of an outer surface profile of the tapered head portion of the polymer nose element and an outer surface profile of a jacketed portion of the projectile, wherein the ogive radius is the same for each of the outer surface profile of the tapered head portion of the polymer nose element and the outer surface profile of a jacketed portion of the projectile.

14. The projectile of claim 12, further comprising an ogive radius for each of an outer surface profile of the tapered head portion of the polymer nose element and an outer surface profile of the tapered end of the metal tip, wherein the ogive radius is the same for each of the outer surface profile of the tapered head portion of the polymer nose element and the outer surface profile of the tapered end of the metal tip.

15. The projectile of claim 12, further comprising an ogive radius for each of an outer surface profile of the tapered head portion of the polymer nose element, an outer surface profile of the tapered end of the metal tip, and an outer surface profile of a jacketed portion of the projectile, wherein the ogive radius is the same for each of the outer surface profile of the tapered head portion of the polymer nose element, the outer surface profile of the tapered end of the metal tip, and the outer surface profile of a jacketed portion of the projectile.

16. The projectile of claim 12, wherein the unitary body further comprises a core that defines the first cavity, the first cavity being a cylindrical cavity concentric with an axis of the projectile.

17. The projectile of claim 12, wherein the unitary body further comprises a forward portion that defines an opening to the first cavity, the forward portion in contact with the first shank portion of the polymer nose element so as to secure the nose insert to the unitary body.

18. The projectile of claim 12, wherein the nose insert is disposed within the unitary body, such that a rear surface of the first shank portion of the polymer nose element is not in contact with a bottom surface of the first cavity of the unitary body.

19. The projectile of claim 18, wherein in response to impact of the projectile with a target, the nose insert is configured to move rearward within the first cavity of the unitary body to expand the projectile.

* * * * *